US005367285A

United States Patent [19]

Swinehart et al.

[11] Patent Number: 5,367,285

[45] Date of Patent: Nov. 22, 1994

[54] METAL OXY-NITRIDE RESISTANCE FILMS AND METHODS OF MAKING THE SAME

[75] Inventors: Philip R. Swinehart; S. Scott Courts, both of Columbus; D. Scott Holmes, Westerville, all of Ohio

[73] Assignee: Lake Shore Cryotronics, Inc., Westerville, Ohio

[21] Appl. No.: 25,411

[22] Filed: Feb. 26, 1993

[51] Int. Cl.[5] ..... H01C 1/012

[52] U.S. Cl. ..... 338/308; 338/22 R; 338/22 SD; 338/25; 204/192.21

[58] Field of Search ..... 338/34, 35, 306, 307, 338/308, 22 R, 22 SD, 25; 252/520, 518; 204/192.21

[56] References Cited

U.S. PATENT DOCUMENTS

| | | | |
|---|---|---|---|
| 3,591,479 | 7/1971 | Stern . | |
| 3,664,943 | 5/1972 | Kumagai et al. . | |
| 3,763,026 | 10/1973 | Cordes | 204/192 |
| 3,803,057 | 4/1974 | Wasa et al. . | |
| 4,016,061 | 4/1977 | Wasa et al. . | |
| 4,025,892 | 5/1977 | Pompei et al. | 338/35 |
| 4,100,524 | 7/1978 | Kirsch | 338/2 |
| 4,104,421 | 8/1978 | Maher et al. | 252/518 |
| 4,104,607 | 8/1978 | Jones | 338/9 |
| 4,183,746 | 1/1980 | Pearce et al. | 106/39.5 |
| 4,280,114 | 7/1981 | DelVecchio et al. | 338/2 |
| 4,359,372 | 11/1982 | Nagai et al. . | |
| 4,398,169 | 8/1983 | Hayashi | 338/22 |
| 4,454,495 | 6/1984 | Werner et al. | 338/195 |
| 4,521,287 | 6/1985 | Kisner . | |
| 4,526,785 | 7/1985 | Trotter, Jr. | 428/410 |
| 4,609,903 | 9/1986 | Toyokurra et al. | 338/22 |
| 4,774,151 | 9/1988 | Cuomo et al. . | |
| 4,849,079 | 7/1989 | Cuomo et al. . | |
| 4,888,246 | 12/1989 | Kuwata et al. . | |
| 4,895,765 | 1/1990 | Sue et al. . | |
| 4,906,968 | 3/1990 | Gershenfeld et al. | 338/308 |
| 4,997,538 | 3/1991 | Luthier et al. . | |
| 5,030,522 | 7/1991 | Luthier et al. . | |
| 5,108,571 | 4/1992 | Ludwig et al. . | |
| 5,156,725 | 10/1992 | Doktycz et al. . | |
| 5,158,933 | 10/1992 | Holtz et al. . | |
| 5,171,412 | 12/1992 | Talieh et al. . | |

FOREIGN PATENT DOCUMENTS

| | | |
|---|---|---|
| 62-269102 | 11/1987 | Japan . |
| 63-224201 | 9/1988 | Japan . |

OTHER PUBLICATIONS

Holmes et al, "Resolution and Accuracy of Cryogenic Temperature Measurements", Temperature: Its Measurement and Control in Science and Industry, vol. 6, part 2, *American Inst. Phys.*, pp. 1225–1230 (1992).

(List continued on next page.)

*Primary Examiner*—Marvin M. Lateef
*Attorney, Agent, or Firm*—Nixon & Vanderhye

[57] ABSTRACT

Film resistors, for example, thin film thermistors having a negative temperature coefficient (NTCR) or near-zero TCR electronics resistors, are formed of an alloy of both an electrically insulating oxide and an electrically conducting nitride of at least one metal selected from titanium, tantalum, zirconium, hafnium and niobium. The electrically insulating oxide of the at least one metal is preferably present in the film sufficient to impart a negative temperature coefficient of resistance to thermistors which include the film as a component part. Preferably, the metal is reactive with both an oxygen-containing gas and nitrogen and is deposited onto a substrate by reactive sputtering in the presence of an inert gas (e.g., argon). By controlling the volume ratio of the reactive gasses (e.g., the volume percent of the oxygen-containing gas in the nitrogen gas) and/or flow rate of the reactive gasses with all other parameters constant, the range of temperature coefficient of resistance (TCR) can be "engineered" for a particular film resistor and can thus be usefully employed as thin film thermistors or near-zero TCR electronics resistors as desired.

27 Claims, 4 Drawing Sheets

OTHER PUBLICATIONS

Yotsuya et al, "Thin Film Cryogenic Thermometer with Thermometric Calibration Point", *Proceedings of the 5th Sensor Symposium,* pp. 9–14 (1985).

Yotsuya et al, "New Type Cryogenic Thermometer Using Sputtered Zr–N Films", *Appl. Phys. Lett.*.51(4), 27 Jul. 1987.

Yotsuya et al, "Zr–N Thin Film Thermometer for Cryogenic Temperature", pp. 154–155 (Jan. 19, 1982).

Gershenfeld et al, "Percolating Cermet Thin-Film Thermistors Between 50 mK–300K and 0–20 T", *J. Appl. Phys.* 64(9), 1 Nov. 1988.

Meng et al, "Electrical Transport and Optical Properties of Zirconium Nitride/Aluminum Nitride Multilayers", *J. Appl. Phys.* 69(2), 15 Jan. 1991.

Luthier et al, "Magnetron Sputtered TiAlON Composite Thin Films. I. Structure and Morphology", *J. Vac. Sci. Technol. A* 9(1), pp. 102–109 Jan./Feb. 1991.

Luthier et al, "Magnetron Sputtered TiAlON Composite Thin Films. II. Optical and Electrical Properties", *J. Vac. Sci. Technol. A* 9(1), pp. 110–115 Jan./Feb. 1991.

METAL OXY-NITRIDE RESISTANCE FILMS AND METHODS OF MAKING THE SAME

FIELD OF INVENTION

This invention is related to resistance films that can be engineered so as to exhibit desired temperature coefficient of resistance (TCR) values. The resistance films of this invention may usefully be employed as thermistors having negative temperature coefficients of resistance (NTCR) and which can be adjusted at will during fabrication so as to provide maximum sensitivity compatible with the desired temperature range of operation. The invention is further related to the special case of such devices which are employed as electronics resistors with near zero temperature coefficient of resistance.

BACKGROUND AND SUMMARY OF THE INVENTION

In the manufacture of commonly known NTCR thermistors, the materials are typically bulk sintered bodies of mixed oxides of metals such as Bi, Ru, Fe, Ni, Co, Mn, W, Mo and the like, or thick film compositions involving these or similar materials sintered together or in a glass binder. They are provided with two metallic electrical contacts, typically alloys of noble metals, fired on at high temperatures. These devices have high sensitivities, limiting the temperature range of a single device. Since the bulk thermistors are "stand alone" units, and the thick films must be made with techniques such as silk screening, their size and utility for integrating with other devices is limited. They must also be fired at high temperatures (greater than 500° C.), which limits their possible integration with other devices, such as silicon integrated circuits.

Thin film thermistors are also known, such as doped silicon carbide and silicon semiconductor resistors, gold particles in germanium, and platinum particles in alumina, formed on one side of a substrate and provided with two electrical contacts. See, U.S. Pat. No. 4,359,372 to Nagai et al, the entire content of which is expressly incorporated hereinto by reference. The doped semiconductor thermistors are conventional positive temperature coefficient (PTCR) devices with limited adjustability of TCR, and the metal precipitates in insulating matrices are either difficult to make controllably or are unstable at temperatures of 20° C. to 300° C. (See in this regard, U.S. Pat. Nos. 5,158,933 to Holtz et al and 4,370,640 to Dynes et al.) Semiconductor thermistors are also prone to magnetic field-induced errors.

A zirconium nitride thin film thermistor is also known from published Japanese Patent Application (Kokai) No. 63-224201 to Yotsuya et al. More particularly, the thermistor disclosed in Yotsuya et al is a system which includes zirconium nitride as an electrical conductor and "excess nitrogen" as an electrical insulator or defect-causing additive.

The type of system incorporating mixtures of conducting and insulating phases and exhibiting more-or-less logarithmic, NTCR variation of resistance with temperature are variously described as "percolation" or "hopping" conductivity systems. The insulating or defect-causing phases do not "dope" the conductor in the sense of a semiconductor, but instead interfere with the conduction of electrical current in the metal by introducing barriers to conduction, which must be circumvented, surmounted or tunneled through. As more insulating phase is added to the conducting phase, the resistivity increases. At the same time, the temperature coefficient of resistance (TCR) decreases from the positive value of the pure metal. With further addition of the insulating or defect-causing phase, the TCR passes through zero and increases in negative value. In most systems, such as cermets (e.g., platinum particles dispersed in alumina), a transition to an insulating state is eventually reached. In others, such as the Zr/excess nitrogen system disclosed in Yotsuya et al cited above, the insulating stage is never reached.

The type of material disclosed in Yotsuya et al is also very wide range (millikelvins to room temperature (295±5K) and very resistant to magnetic field-induced errors, even at liquid helium temperatures (4.2K); for instance, less than 1% of temperature error up to 5 Tesla magnetic fields. There are, however, several disadvantages associated with the type of material disclosed in Yotsuya et al, such as:

1. The "excess nitrogen" insulating phase is unstable, even at temperatures as low as 375K, because the "excess nitrogen" is only weakly bound and causes its insulating effect with defects and included gas that are metastable.
2. There is a limit to the amount of "excess nitrogen" the films can take up, and the range of resistances and TCR's obtainable are limited.
3. Other metals which have conducting nitrides do not uniformly take up "excess nitrogen" in the same way zirconium does, and therefore what desirable properties those metals may have are not available for exploitation.

The present invention is embodied in novel metal oxy-nitride alloys which form electrical film resistors and which can be "engineered" so as to exhibit the desired TCR and which address many of the disadvantages of conventional film thermistors described above.

Broadly, the present invention provides film resistors which are formed of an alloy of both an electrically insulating oxide and an electrically conducting nitride of at least one metal. During manufacture of the thin film resistance materials according to this invention, reactive gases of an oxygen-containing gas and nitrogen gas are introduced into a reaction chamber (preferably as a mixture) in the presence of an inert gas and a metal or a metal composite (e.g., pressed powder) target capable of forming both oxides and nitrides. The ratio of the oxygen-containing gas to nitrogen gas and/or the total volume flow rate are selectively controlled so as to obtain a desired amount of metal oxide to metal nitride in the oxy-nitride metal film that is formed in the reaction chamber. By varying the amount of oxygen-containing gas in the reaction gas and/or flow rate of the reaction gas with all remaining parameters constant, the amount of metal oxide in the metal film alloy may be predetermined so as to achieve desired TCR characteristics.

These as well as other aspects and advantages of this invention will become more clear after careful consideration is given to the following detailed description of the preferred exemplary embodiments.

BRIEF DESCRIPTION OF THE ACCOMPANYING DRAWINGS

Reference will hereinafter be made to the accompanying drawings wherein.

DETAILED DESCRIPTION OF THE PREFERRED EXEMPLARY EMBODIMENTS

Figure 1:
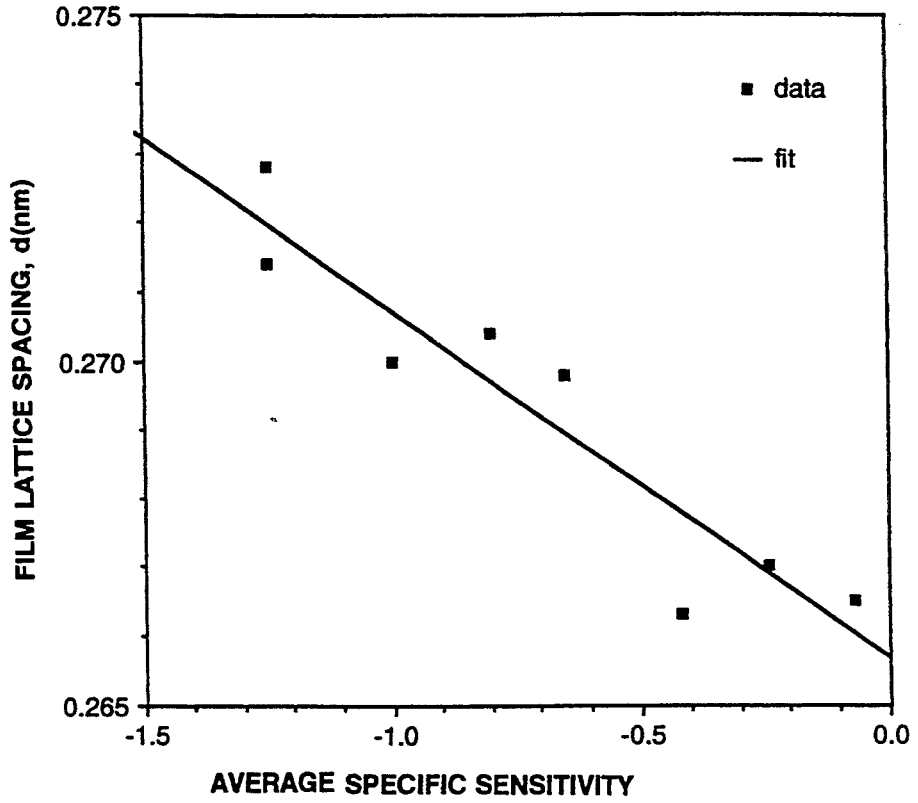
FIG. 1 is a graph showing the lattice constants of zirconium oxy-nitride films, as obtained by X-ray diffraction, as they vary with the average specific sensitivity.

The thin film resistors of this invention are especially characterized by virtue of the film being a metal oxy-nitride alloy and by their respective near-zero or large negative temperature coefficients of resistance. That is, the thin film resistors of this invention will be an alloy of both at least one electrically insulating oxide and an electrically conducting nitride of at least one metal which is capable of forming both a metal oxide and a metal nitride under reaction conditions. The metal oxide is, moreover, present in the thin film metal oxy-nitride alloys of this invention in an amount sufficient to provide for a desired temperature coefficient of resistance. These conditions do not preclude the inclusion of small amounts of conducting oxide phases which may form in the plasma with the insulating phases or be intentionally added, provided that the major electrically conducting phase is a nitride.

The metal oxy-nitride film resistors of this invention are especially characterized by their specific sensitivity, $S_{sp}=d\ln R/d\ln T$, where R is the resistance and T is the temperature (kelvins). The specific sensitivity is dependent only on the intrinsic properties of the film and independent of the film geometry. In contrast, the sensitivity that the user observes in a thermometer is the rate of change of the resistance with temperature, dR/dT, which scales with the film geometry. Thus, a shorter distance between electrical contacts associated with a thin film resistor or thermistor according to this invention will translate into a reduction of dR/dT by the same proportion.

The metal oxy-nitride films of this invention have a non-linear resistance/temperature characteristic, even on a log-log scale. As a result, thin films having varying amounts of metal oxide in the alloy are difficult to compare simply. However, an approximate comparison can be made by taking an average specific sensitivity between room temperature (approximately 295K) and liquid nitrogen temperature (77.35K). Therefore as used herein and in the accompanying claims, the term "average specific sensitivity" is intended to refer to a value which is expressed as $\ln(R_1/R_2)/\ln(T_1/T_2)$, where $T_1$ and $T_2$ represent the liquid nitrogen temperature and room temperature, respectively, and $R_1$ and $R_2$ represent the resistance in ohms (Ω) at temperatures $T_1$ and $T_2$, respectively.

The metals that may successfully be employed in the practice of this invention are those which are capable of forming both a metal oxide and a metal nitride under suitable conditions, for example, using a reactive gas comprised of an oxygen-containing gas and nitrogen. The metals may be, for example, titanium, tantalum, hafnium, zirconium, and niobium. These metals may be used alone, but could likewise be used in combinations of two or more so as to achieve the desired metal oxy-nitride film.

The film resistors of this invention can be fabricated using any film deposition technique well known in this art. For example, thin films may be fabricated using reactive sputtering of a pure metal target or a composite target of oxides, nitrides and/or metals, reactive evaporation, ion and ion assisted sputtering, ion plating, molecular beam epitaxy, chemical vapor deposition and deposition form organic precursors in the form of liquids. Preferably, however, the thin film metal oxy-nitride alloys of this invention are fabricated by reactive sputtering.

In the preferred reactive sputtering process, a metal target (which, as indicated previously, may be a combination of suitable metals) is sputtered onto a suitable substrate material in the presence of a reactive gas (which is preferably a mixture of both an oxygen-containing gas and a nitrogen gas in a suitable ratio) and an inert gas within a reaction chamber. Alternatively, a properly mixed target of the oxide and nitride ceramics could be sputtered in an atmosphere with sufficient background content of oxygen and nitrogen to prevent reduction of the sputtered material to the metal.

The substrate material may be any suitable, readily available, electrically insulative material (e.g., alumina, sapphire, or the like) which (i) is chemically and physically compatible with the metal oxy-nitride film to be formed on at least one of the substrate surfaces, (ii) is stable at the deposition temperatures; and (iii) possesses a thermal expansion coefficient matching closely enough the thermal expansion coefficient of the film so that instability due to stress is not induced. The substrate should also preferably be of high purity. For example, when using alumina as a substrate in a reactive sputtering process, it is preferred to use 99.6% electronic grade alumina, mechanically polished to 0.3 microinch smoothness. If sapphire is employed as a substrate material, it is preferably a single crystal sapphire which has been chemically/mechanically polished to epitaxial quality.

Virtually any inert gas may be employed in the reactive sputtering process to form the films of this invention. Preferably, however, the inert gas will be argon for reasons of expense, but other inert gases such as neon, xenon and krypton could also be used. The selection of any particular inert gas is a balance between the economics of using a particular inert gas and the film properties that can be achieved as a result of its use. When used in the reactive sputtering process, it is desirable to purify the inert gas so as to remove water vapor and oxygen, for example, by passing the gas over a suitable exchange resin.

The reactive gas that is employed contains both an oxygen-containing gas and a nitrogen gas. Preferably the oxygen-containing gas is $O_2$. Nitrous oxide or ozone could likewise be employed but for practical reasons are less desirable since they are toxic.

The three necessary gases—i.e., the inert gas and the reactive gasses comprised of an oxygen-containing gas and a nitrogen gas—may be admitted into the reaction chamber individually or, more preferably from the viewpoint of film consistency, premixed. That is, it is preferred to admit the argon separately into the reaction chamber but to premix the oxygen and nitrogen gases and then introduce the premixed oxygen and nitrogen gases into the reaction chamber. In general, between about 0.1 to 30 vol. % $O_2$ in nitrogen, and more preferably between about 0.5 to 10 vol. % $O_2$ in nitrogen, is employed in the reactive sputtering process due to the greater reactivity of the $O_2$ as compared to nitrogen. The reactive sputtering can either be accomplished using a substantially pure target (i.e., a target which is substantially free of reaction products) so as to increase the deposition rate, or a "poisoned" target (i.e., the target metal is allowed to react with the oxygen and nitrogen prior to being sputtered off the target).

The substrate temperature range during reactive sputtering in which the negative temperature coefficient of resistance effect can be produced is from below room temperature up to about 700° C. Preferably, however, the substrate temperature range is between 250° C. to 600° C. during reactive sputtering. Below 250° C., the films have a tendency to peel from the substrate and exhibit a high degree of porosity and imperfection which lead to drift and high scatter in the thermometry properties. Above 600° C., however, the magnetoresistances of the films change which may be used beneficially in some cases and may be detrimental in other cases, depending on the intended use of the sensor.

The range of total gas pressure during deposition can be from 0.066 pascals to 6.6 pascals or higher, and more preferably between about 0.13 pascals to 1.33 pascals. The gas partial pressures do not necessarily need to be controlled directly, but their values are related to the gas flow versus magnetron power. The total pressure should be controlled to maintain a constant gas collision rate as the reactive gas portion is varied to obtain different TCR's. In this regard, the mass flow of argon can be set at a value compatible with the pumping speed available and the desired total pressure. Magnetron power may then be chosen and fixed. The mass flow of the oxygen/nitrogen mixture can then be set at differing volume percentages of the argon flow to obtain the desired temperature coefficient of resistance. The pumping speed may then set according to a high sensitivity pressure sensor (e.g., a high sensitivity capacitance manometer) so as to maintain the desired total pressure.

The ratio of the reactive gas flow (i.e., the volume flow of the oxygen/nitrogen gas mixture) to the argon gas flow is preferably between about 0.1 to 5, but more preferably is between 0.3 to 3. At such reactive gas flow ratios, films from Nb, Ta, Zr and Hf can be produced with specific sensitivities between about −0.25 and −2. For Ti, however, 5 vol. % $O_2$ in $N_2$ is preferable in order to produce the same range of specific sensitivities with substantially the same range of reactive gas to Ar ratios (volume basis). If the magnetron power is changed, the flow of the reactive gas must be changed in the same direction. If the $O_2$ to $N_2$ ratio is changed, the range of reactive gas to Ar ratios will change in the opposite direction in order to achieve the same specific sensitivity.

The absolute value of the specific sensitivity (i.e., $|S_{sp}|$) for the metal oxy-nitride films of this invention is the smallest for the smallest percentage of reactive gas (i.e., the combined oxygen and nitrogen flow), and increases with the percentage increase of reactive gas until an insulating film is obtained. However, before the insulating condition is reached, the films develop a "capacitive" aspect which slows their response to the application of electrical excitation to as much as several seconds, which limits the useful films to a reactive element content which produces an absolute value of the specific sensitivity of less than about 3.0 in the region of room temperature, depending on the requirements of use. At the other extreme, nearly stoichiometric nitride films of the metals described previously can be made with the reactive sputtering method described above using pure nitrogen flow in addition to the argon, and these films exhibit a positive temperature coefficient.

The flow rate of the reactive gas during sputter deposition affects the structure of the metal oxy-nitride films, which in turn affects the electrical properties. Films formed with low flow rates of reactive gas consist mostly of ZrN, which has a cubic structure. In this regard, scanning and transmission electron microscope (SEM and TEM, respectively) examination of film morphology reveals a completely dense microstructure. The films typically show a preferred (111) orientation of crystal planes in the plane of the substrate. As the flow of oxygen/nitrogen reactive gas mixture is increased, the mean spacing, d, between (111) planes in the film increases, indicating enlargement or distortion of the lattice by incorporation of additional oxygen in the crystal lattice. The relationship between the lattice spacing d and the specific sensitivities (which vary directly with the reactive gas flow rates) of zirconium oxy-nitride films according to this invention is shown in FIG. 1.

Figure 2:
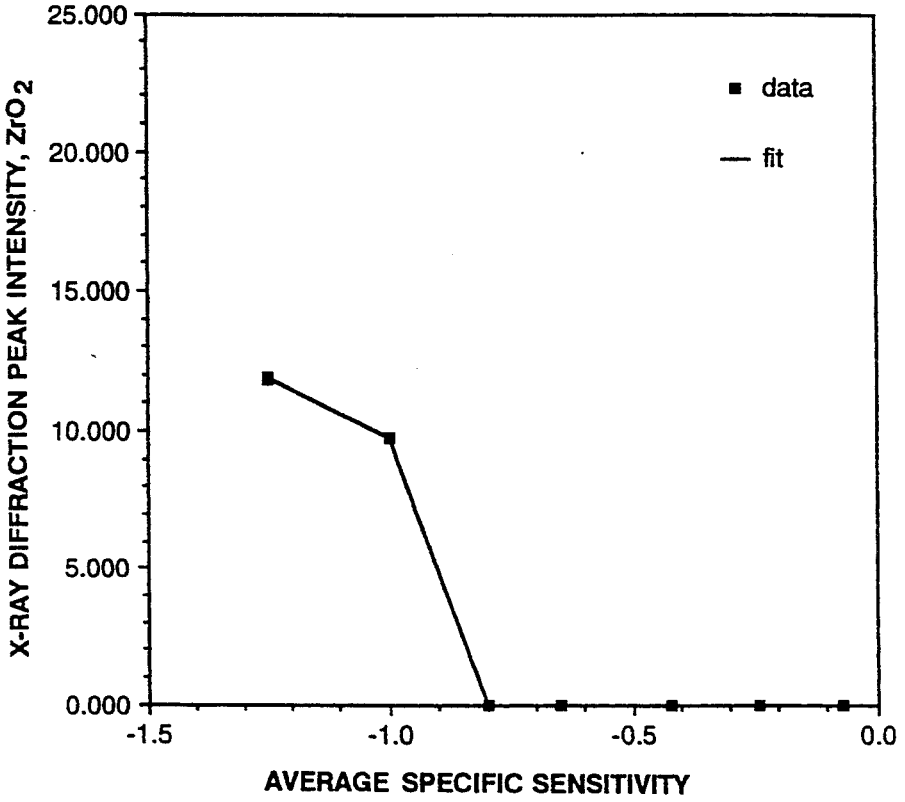
FIG. 2 is a graph of X-ray diffraction data showing the emergence of the $ZrO_2$ tetragonal phase as the reactive gas flow is increased and the average specific sensitivity becomes larger.

The oxygen present in the film is incorporated into the lattice of the ZrN until a specific sensitivity of about −0.6 is reached. At this point, the formation of a separate phase, $ZrO_2$, becomes evident as is seen from FIG. 2. The $ZrO_2$ is electrically insulating and tetragonal in structure, and its presence continues to distort the ZrN lattice (see FIG. 1), increasing the absolute value of the specific sensitivity.

Figure 3:
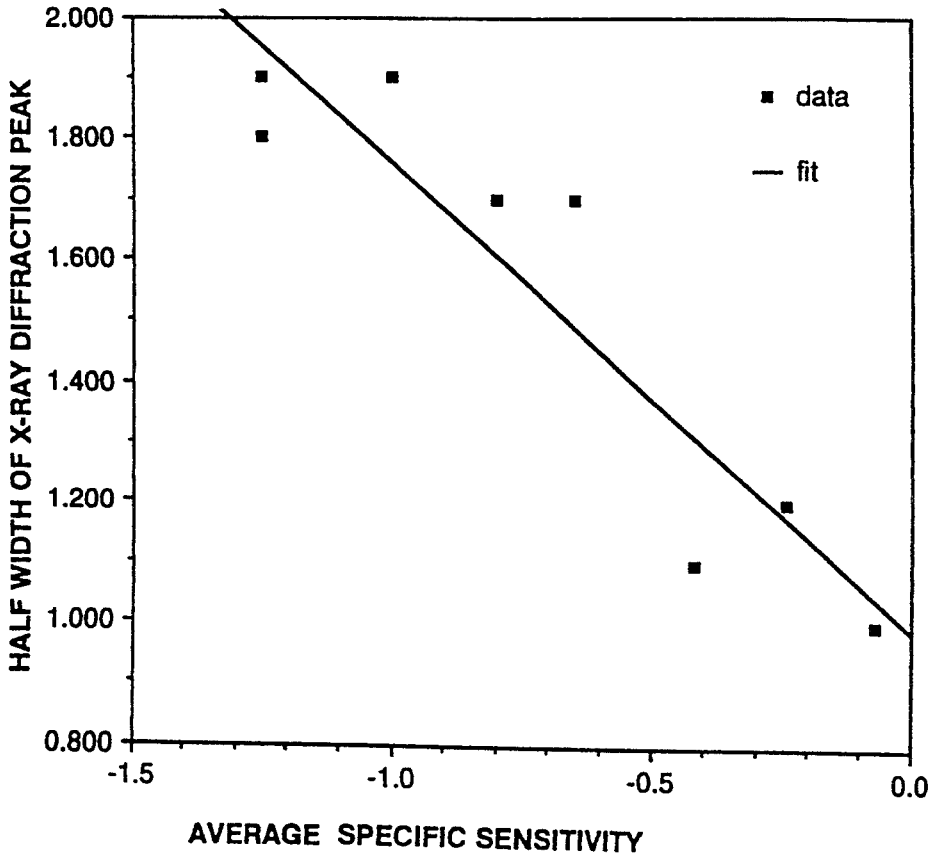
FIG. 3 is a graph of X-ray diffraction data showing the broadening of the half width of the X-ray diffraction peak as the reactive gas flow is increased and the average specific sensitivity becomes larger which indicates increasing distortion of the host ZrN lattice.

Evidence for increased distortion of the crystal lattice is also present by virtue of the increased width of the x-ray diffraction peaks from (111) planes. Distortion of the lattice correlates with decreasing electrical conductivity and increasing NTCR in the deposited film. At sufficiently large reactive gas flow rates, the distortion becomes so large that nucleation of $ZrO_2$ grains becomes favorable. Cross-sectional and plan-view TEM examinations show that tetragonal $ZrO_2$ grains with an average size of a few nm are dispersed in the cubic NaCl-type structure of the ZrN. In this regard, as is seen in accompanying FIG. 3, the diffraction peak is broader than that for stoichiometric ZrN for all negative specific sensitivities, but never as broad as would be expected for amorphous material, thereby indicating a distorted periodic lattice. The specific sensitivity increases with the width in the same manner as with the lattice spacing.

One particularly novel structural aspect of the metal oxy-nitride films according to this invention is that the insulating metal oxide (e.g., $ZrO_2$) phase, does not become the major, or host, phase, even at specific sensitivities beyond the useful range (about $|S_{sp}| > 3$, 300K to 77K). Conversely, conventional cermets having the same type of resistivity versus temperature characteristics must have the insulating phase be the major phase, or nearly so (greater than 40% by volume), to have an appreciable specific sensitivity.

In general, the metal oxy-nitride films of this invention exhibit an average specific sensitivity of between about +0.5 to about −5.0. Within this wide range of average specific sensitivities will therefore be film resistors useful for fabricating thermistors (e.g., films having an average specific sensitivity between about −0.25 to about −2.0), and circuit resistors (e.g., films having an average specific sensitivity between about ±0.5, and more preferably between about ±0.03). As a few examples, films with an average specific sensitivity between about −0.25 to about −0.4 can be used in thermometry from above room temperature to as low as a few tens of millikelvins. On the other hand, films with an average specific sensitivity between about −0.4 to about −1.0 can be used in thermometry from well above room temperature to below 1 K. Films with an average specific sensitivity from about −1.0 to about −1.5 are useful from about 4K to above room temperature, and films with an average specific sensitivity from about −1.5 to −2 are useful from temperatures about 10K to 20K to above room temperature. Space charge effects begin to be a consideration above about an absolute value of the average specific sensitivity of 2. The exact temperature range of usefulness depends upon the geometry (hence the total resistance) and the measuring instrument capability. By way of comparison, platinum resistance thermometers have a specific sensitivity of about +1, and conventional bulk thermistors have specific sensitivities from about −3 to −6.

Figure 4:
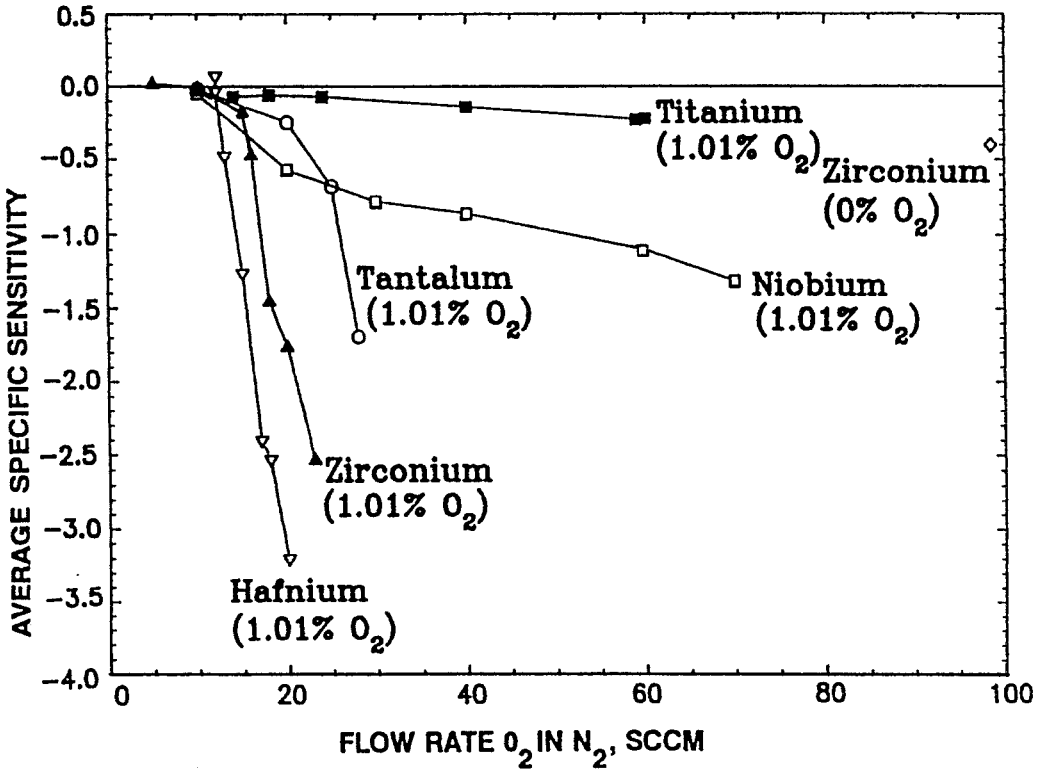
FIG. 4 is a graph which plots the average specific sensitivity near room temperature versus the reactive gas flow for several metal oxy-nitride films according to this invention using a fixed volume percent of $O_2$ in $N_2$.

The stoichiometric nitrides of this group of metals, TiN, NbN, TaN, ZrN and HfN are metals that exhibit a positive temperature coefficient. FIG. 4 shows that films can easily be formed by this method with an average specific sensitivity of about ±0.03. The temperature coefficient is equivalent to about ±100 parts per million (ppm) per °C., which is quite adequate for room temperature electronic circuit resistors. Further, this low TCR is maintained over a very wide range of temperatures (±200° C.), in contrast to most conventional thick film electronics resistors, which frequently increase to 400 ppm at ±50° C. from 100 ppm at 25° C.

The metal oxy-nitride films according to this invention may be fabricated into thin film thermistors of desired geometry employing conventional fabrication technology. For example, the metal oxy-nitride films of this invention may be fabricated into thermistors and resistors having the geometry as described in commonly owned and copending U.S. application Ser. No. 08/024,273 filed even date herewith in the name of Philip R. Swinehart (Atty. Dkt. No. 340-21), the entire content of which is expressly incorporated hereinto by reference. In this regard, the thermistors and resistors will include at least one pair of electrical contacts in electrical communication with the film so as to electrically connect the film to external circuitry.

The electrical contacts employed with the metal oxy-nitride films of this invention must be stable. That is, if the contact resistances are not sufficiently stable, the instability will be read by sensing circuitry as a temperature change or drift out of resistance tolerance (since the contact resistances will add in series with the desired resistance of the active film material). Thus, stable electrical contacts employed with the metal oxy-nitride films of this invention are selected so as to substantially avoid exchange of oxygen at the electrode/film interface. That is, since oxygen is a very reactive element, and since the metal oxy-nitride films according to this invention contain oxides, the choice of improper electrodes could cause a chemical reaction with the resulting exchange of oxygen between the electrodes and the active body. The oxide loss or gain of oxygen in the active body film will affect the resistance, and further, if the electrode material forms an insulating oxide, a large series resistance error will occur. Reactive metals which form insulating oxides, such as Ti, Zr, Ta and Hf, must therefore be avoided as electrical contact materials.

The materials from which stable electrical contacts can be fabricated for use with the metal oxy-nitride films according to this invention include low oxidation potential metals such as Pt, Rh, Pd, W, Mo, Ru, Re, Os and Ir, as well as rutile crystal structure oxides of such metals, i.e., $WO_2$, $ReO_2$, $RuO_2$, $RhO_2$, $MoO_2$, $IrO_2$, $PtO_2$ and $OsO_1$. Electrical contacts can also be formed of relatively simple sodium chloride structure oxides, such as TiO, NbO, $SnO_2$, $In_2O_3$, $WO_3$ and $MoO_3$ can be employed if self-doped by non-stoichiometry. Oxides having a perovskite crystal structure, such as $ReO_3$, may also be employed. Electrical contacts formed of the materials described above will provide enhanced stability at substantially higher temperature than room temperature and under thermal cycling stress.

The present invention will be further described by way of the following non-limiting examples.

EXAMPLE 1

A 2.5 cm diameter permanent magnet magnetron was used in a cryopumped vacuum system capable of a base pressure in the $7\times10^{-6}$ pascal range. The substrates were mechanically polished 99.6% alumina or epitaxially polished R-cut sapphire placed at 7 to 10 cm from the magnetron. The substrates were cleaned with an argon ion beam and heated to about 300° C. The magnetron power was fixed at 150 Watts dc and the total pressure was 0.266 pascal to limit the number of collisions for sputtered atoms before they reached the substrate. An ultra-high purity grade, 1.01 vol. % $O_2$ in $N_2$ was used for Ta, Zr, Hf, and Nb.

The flow rate of Ar was chosen to be in the mid-range of flow and throttle control (33 sccm) so that no other parameters would have to be changed as the reactive gas flow was changed. The following procedures were followed: (1) the gas flows were established; (2) the pump throttle valve was set so that the total pressure was 0.266 pascal, (3) the target was conditioned by presputtering with the shutter closed for several minutes; and then (4) film formation was accomplished by sputtering for a sufficiently long time to obtain films in the 300 nm thickness range. Between each deposition, the thickness was measured on a stylus profilometer and the average specific sensitivity was measured with a four point probe between room temperature and liquid nitrogen temperature. The obtained data were plotted and appear in accompanying FIG. 4.

COMPARATIVE EXAMPLE 1

A single datum point was obtained and plotted in accompanying FIG. 4 by following the procedures of Example 1 above, but using pure nitrogen in argon for zirconium so as to replicate the condition disclosed in Yotsuya, et al (Japanese Patent Application (Kokai) No.

63-224201). The film according to this Comparative Example 1 was made that the highest nitrogen flow that could be obtained while still maintaining the plasma in the magnetron and thus produced the highest sensitivity possible without oxygen. As is seen in accompanying FIG. 4, the conditions followed in this Comparative Example 1 produced an average specific sensitivity of only −0.4.

EXAMPLE 2

In order to evaluate the effect of a change in the oxygen to nitrogen ratio, Example 1 was repeated for titanium, except that 30 vol % $O_2$ in $N_2$ was used which was further mixed with pure $N_2$ in a chamber connected to the sputtering system in order to obtain mixtures corresponding to 5 vol. %, 10 vol. % and 30 vol. % $O_2$ in $N_2$. Titanium oxy-nitride films having a wide range of sensitivities, from zero to an absolute value of the average specific sensitivity greater than 2 were fabricated as shown by the data appearing in accompanying FIG. 5 (which also includes the data for titanium oxy-nitride films produced using 1.01 vol. % $O_2$ in $N_2$ obtained according to Example 1 above).

EXAMPLE 3

Six zirconium oxy-nitride film samples were fabricated into finished thermistors identified as R1 through R6, respectively, having a geometry as disclosed in the Examples of the above-identified copending U.S. patent application Ser. No. 08,024,273 (Atty. Dkt. 340-22). The thermistors R1–R6 were each wire bonded (gold thermosonic ball bonded) and sealed into hermetic ceramic packages. Experimental calibration data for each of the thermistors was obtained by a calibration system using secondary standard thermometers and resistance standards traceable to the National Institute of Standards and Technology (NIST). The obtained calibration data appear in FIG. 6.

Figure 5:
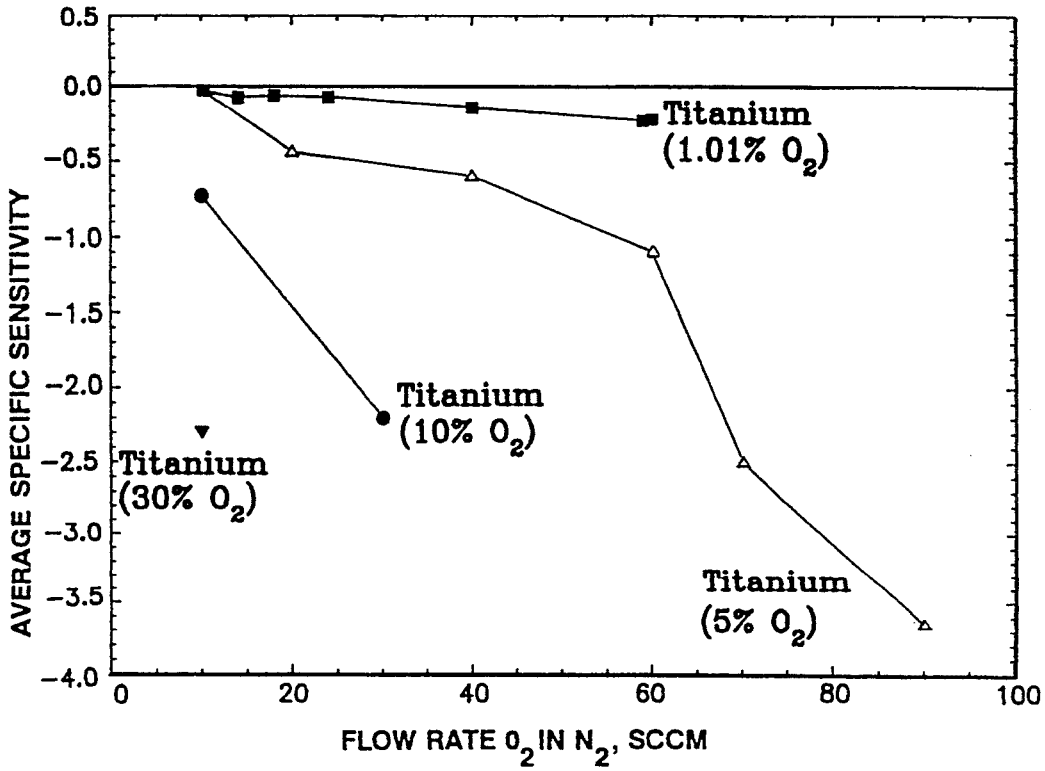
FIG. 5 is a graph similar to FIG. 4, but showing the effects of an increasing volume percent of $O_2$ in $N_2$ for titanium oxy-nitride films according to this invention.
Figure 6:
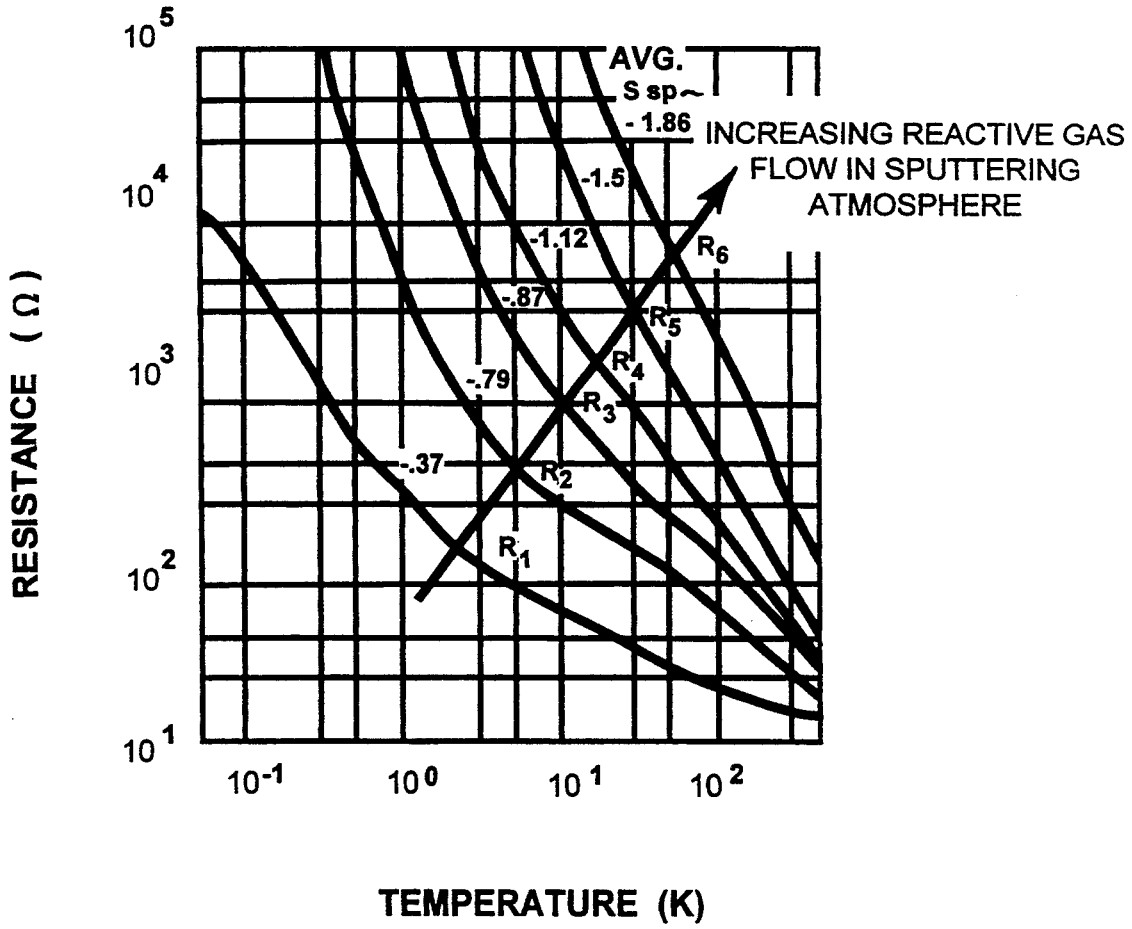
FIG. 6 is a graph showing calibration curves for zirconium oxy-nitride thermistors obtained with different reactive gas flows in the sputtering atmosphere.

The data in accompanying FIGS. 4–6 demonstrate several significant attributes of the metal oxy-nitride films according to this invention. For example, the effect of changing the oxygen to nitrogen ratio can be seen in the data of FIG. 4 relating to the titanium oxy-nitride films. That is, comparing the two curves for titanium in FIG. 5—i.e., the curves representing substantially 1 vol. % $O_2$ in $N_2$ and 5 vol. % $O_2$ in $N_2$, it can be seen that the former reactive gas ratio has little effect, whereas the latter produces a response to increasing reactive gas flow similar to those for Ta, Zr, Hf and Nb metals at the 1 vol. % $O_2$ level. In addition, as can be seen from FIG. 6, films patterned into useful thermistors with stable electrical contacts and then calibrated have average specific sensitivities between −0.30 and −2.0, matching closely the data plotted in FIG. 4. Finally, it can be seen in FIG. 4 that, with the exception of thermistor R1, all of the thermistors R2–R6 exhibit specific sensitivities which are unavailable for the prior art film replicated in Comparative Example 1.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A film resistor comprising an alloy of both an electrically insulating oxide and an electrically conducting nitride of at least one metal wherein said electrically insulating oxide of said at least one metal is present in said film sufficient to impart a predetermined average specific sensitivity to said film resistor.

2. A film resistor as in claim 1, wherein said at least one metal is selected from the group consisting of titanium, tantalum, zirconium, hafnium and niobium.

3. A film resistor as in claim 1, having an average specific sensitivity of between about +0.5 to about −5.0.

4. A film resistor as in claim 1, having an average specific sensitivity of between about −0.25 to about −2.0.

5. A film resistor as in claim 1, having an average specific sensitivity of between about ±0.5.

6. A film resistor comprising:

an electrically insulating substrate;

an electrical resistance film deposited on a surface of said substrate, said electrical resistance film being the deposition reaction product of (i) at least one metal source which is capable of producing both an electrically insulating oxide and an electrically conducting nitride of said metal source, and (ii) at least three gas components consisting essentially of an inert gas, an oxygen-containing gas, and nitrogen; and at least one pair of electrical contacts in electrical communication with said film.

7. A film resistor as in claim 6, wherein said metal source is at least one metal selected from the group consisting of titanium, tantalum, zirconium, hafnium and niobium.

8. A film resistor as in claim 6, having an average specific sensitivity of between about +0.5 to about −5.0.

9. A film resistor as in claim 6, having an average specific sensitivity of between about −0.25 to about −2.0.

10. A film resistor as in claim 6, having an average specific sensitivity of between about ±0.5.

11. A film resistor as in claim 6, wherein said oxygen-containing gas is selected from the group consisting of air, oxygen, nitrous oxide and ozone.

12. A film resistor as in claim 6, wherein said inert and oxygen-containing gases are a premixed mixture.

13. A film resistor as in claim 6, wherein said inert gas is selected from argon, neon, xenon and krypton.

14. A film resistor as in claim 6, wherein said electrical contacts consist essentially of a contact material which substantially avoids oxygen exchange at an interface between said electrical contact and said electrical resistance film.

15. A film resistor as in claim 14, wherein said electrical contacts consist essentially of a metal selected from the group consisting of Pt, Rh, Pd, W, Mo, Ru, Re Os and Ir, or a rutile oxide of said metal.

16. A film resistor as in claim 14, wherein said electrical contacts consist essentially of a non-stoichiometric oxide selected from TiO, NbO, $SnO_2$, $In_2O_3$, $WO_3$ and $MoO_3$.

17. A method of forming a thin film resistor comprising reacting in a reaction zone a source of at least one metal with both an oxygen-containing gas and nitrogen in the presence of an inert gas to form a resistor film which is an alloy of an electrically insulating oxide of said at least one metal and an electrically conducting nitride of said at least one metal.

18. A method as in claim 17, wherein said step of reacting a source of at least one metal with both an oxygen-containing gas and nitrogen in the presence of an inert gas is accomplished by reactive sputtering.

19. A method as in claim 17, wherein said oxygen-containing gas and said nitrogen gas are supplied to said reaction zone as a reactive gas mixture of both said oxygen-containing gas and said nitrogen gas.

20. A method as in claim 19, wherein the oxygen-containing gas is oxygen, and wherein the volume percent of said oxygen gas in said reactive gas mixture is between about 0.1 to about 30.

21. A method as in claim 19, wherein the volume percent of said oxygen gas in said reactive gas mixture is between about 0.5 to about 10.

22. A method as in claim 17, further comprising the steps of heating a substrate, and reactively depositing said metal oxy-nitride alloy film onto said substrate.

23. A method as in claim 22, wherein said substrate is heated to a temperature of up to about 700° C.

24. A method as in claim 22, wherein said substrate is heated to a temperature of between about 250° to 600° C.

25. A method as in claim 17, wherein said oxygen-containing gas is selected from the group consisting of air, oxygen, nitrous oxide and ozone.

26. A method as in claim 17, wherein said inert and oxygen-containing gases are a premixed mixture.

27. A method as in claim 17, wherein said inert gas is selected from argon, neon, xenon and krypton.

* * * * *